US006726180B2

(12) United States Patent
Alten

(10) Patent No.: US 6,726,180 B2
(45) Date of Patent: Apr. 27, 2004

(54) JACK

(75) Inventor: Ferdinand Alten, Mandern (DE)

(73) Assignee: Krupp Bilstein GmbH, Ennepetal (DE)

( * ) Notice: Subject to any disclaimer, the term of this patent is extended or adjusted under 35 U.S.C. 154(b) by 0 days.

(21) Appl. No.: 10/182,005

(22) PCT Filed: Jan. 20, 2001

(86) PCT No.: PCT/EP01/00631

§ 371 (c)(1),
(2), (4) Date: Jul. 11, 2002

(87) PCT Pub. No.: WO01/70617

PCT Pub. Date: Sep. 27, 2001

(65) Prior Publication Data

US 2003/0001145 A1 Jan. 2, 2003

(30) Foreign Application Priority Data

Mar. 18, 2000 (DE) ..... 100 13 485

(51) Int. Cl.[7] ..... B66F 3/00
(52) U.S. Cl. ..... 254/126
(58) Field of Search ..... 254/126, 124, 254/122, DIG. 1, DIG. 3, DIG. 4, DIG. 6, 133, 134, 95

(56) References Cited

FOREIGN PATENT DOCUMENTS

| | | | |
|---|---|---|---|
| EP | 688736 | * | 6/1995 |
| EP | 749936 | * | 5/1996 |

* cited by examiner

*Primary Examiner*—Robert C. Watson
(74) *Attorney, Agent, or Firm*—Max Fogiel

(57) ABSTRACT

The invention relates to a jack comprising a stand body, which rests on the ground (4) and which consists of a stand column (1) and foot (2), and comprising a supporting arm (5), which is fastened to the stand column (1) in a manner that permits it to move around a fixed horizontal pivotal axis, and which is directly or indirectly raised or lowered in relation to the ground (4) by means of a movement spindle (7). The free end (6) of the supporting arm is provided with a fixed or pivotal supporting part, and the end that engages inside the stand column (1) comprises a denticulation, which engages inside a counter denticulation of a control slide (10) and which displaces the control slide (10) parallel to the longitudinal extension of the stand column (1). The aim of the invention is to simplify the control slide (10) and to make the production thereof more economical. To these ends, the invention provides that the stand column (1) is constructed as two parts consisting of a guide part (16), which comprises the counter denticulation, and of a pushing part (17) joined thereto.

17 Claims, 2 Drawing Sheets

JACK

BACKGROUND OF THE INVENTION

The present invention concerns an automotive jack with a vertical main structure resting on the ground and comprising a load supporting arm swinging around a horizontal axis on that structure.

When employing jacks with an upright that can be erected on a foot resting on the ground and with a load-supporting arm articulated at one end to the upright and swinging up to produce a lifting motion in relation to the leg, care must be taken in particular to ensure that the leg is applied, erected on the ground, that is, at a prescribed angle to the ground and to the vehicle being lifted. This is the only way to prevent the load from being improperly accommodated as the vehicle is lifted, with the jack and in some cases the vehicle as well slipping out because the load's line of application does not extend straight through the foot. To ensure that the jack is erected on the ground with its leg at the proper angle even when employed by an unskilled operator accordingly, European Patent 0 688 736 A1 discloses establishing the jack's angle of application by means of a foot-adjustment slide that slides along the leg subject to the motion of the load-supporting arm, whereby either the motion of the foot, connected to the leg, is controlled or, in the event the foot is not movable, another point of application is made available to the jack.

The motion of the load-supporting arm is in the known approach transmitted through a cogged segment at the end of the arm remote from its free end and operating in conjunction with counterparts in the form of matching cutouts in the foot-adjustment slide. There is a drawback to this state of the art in that the slide is a complicated sheet-metal component. The design increases the manufacturing cost along with the weight of the overall jack.

SUMMARY OF THE INVENTION

The object of the present invention is a jack with a simpler and easier to fabricate foot-adjustment slide.

The main advantage or me present invention is that a two-part foot-adjustment slide can be economically fabricated from simple and inexpensive materials. The jack's overall weight will accordingly also be decreased. Another advantage is the simplicity with which the slide can be adapted to legs of different lengths just //be// by mounting a carriage of appropriate length on a track without having to modify the other parts.

BRIEF DESCRIPTION OF THE DRAWINGS

One embodiment of the present invention will now be specified with reference to the accompanying drawing, wherein.

DESCRIPTION OF THE PREFERRED EMBODIMENTS

Figure 1:
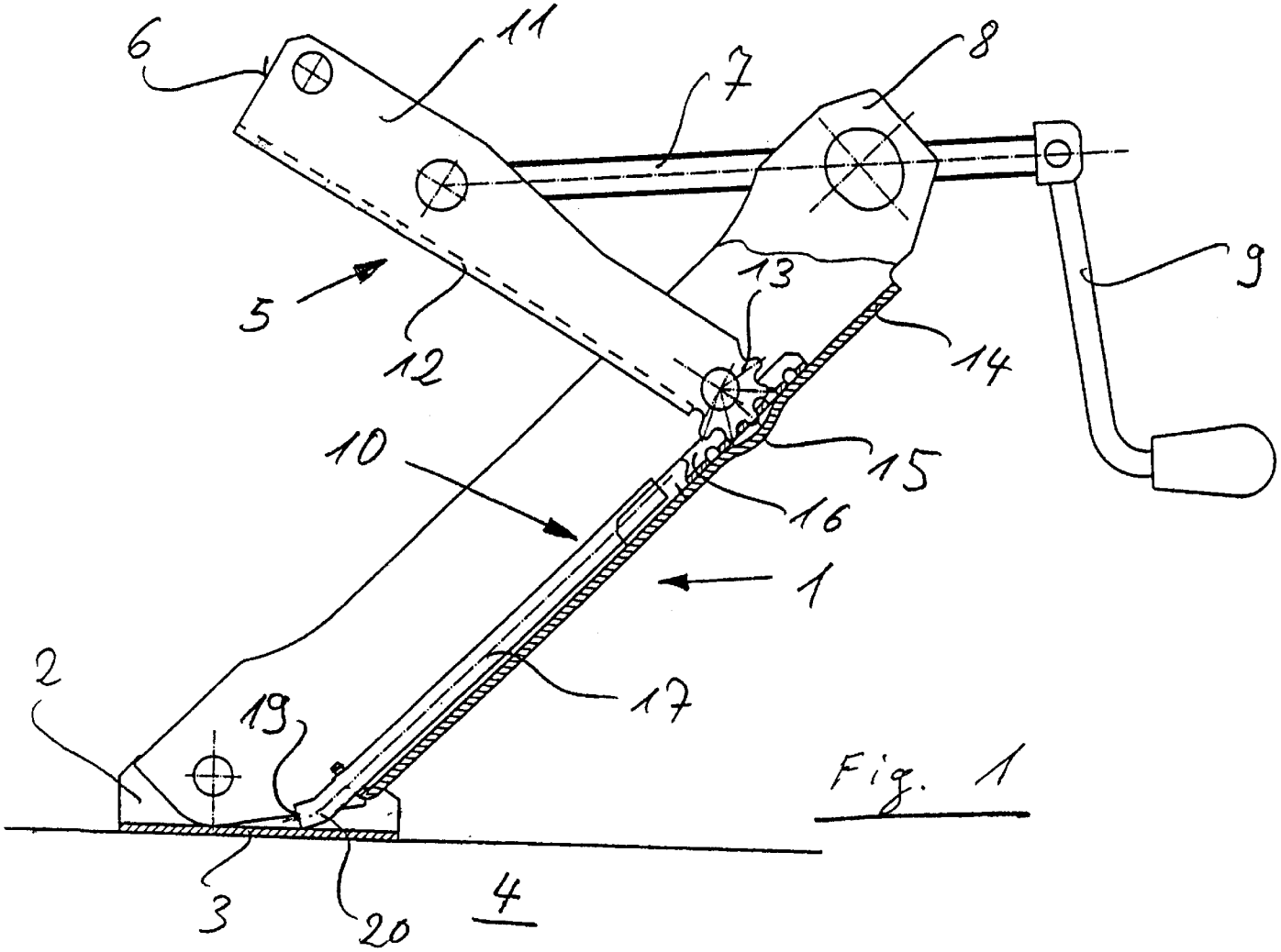
FIG. 1 is a transverse section through a jack in accordance with the present invention, FIG. 2 a lateral view of the foot-adjustment slide, FIG. 3 a view of the foot-adjustment slide, and FIG. 4 a section through the cogged length of the foot adjustment slide.

The jack in the embodiment illustrated in FIG. 1 is an articulated mechanism with a single load-supporting arm and a pivoting foot. It has a vertical main structure that comprises a leg 1 with foot 2 pivoting on its lower end. The bottom 3 of the foot rests on the ground 4. A load-supporting arm 5 is articulated to leg 1 near the latter's upper end. An unillustrated vehicle engaging component is secured to the free end of the arm. The vehicle-engaging component can but need not be capable of tilting, and accommodates for example the vehicle's sill. Leg 1 and load supporting arm 5 are connected by a motion-generating threaded shaft 7, usually provided with a crank 9. An unillustrated traveling nut at the upper end 8 of leg 1 forces arm 5 toward or away from leg 1 as shaft 7 rotates, raising and lowering the arm's free end 6 and hence varying the distance between the vehicle and ground 4.

Figure 4:
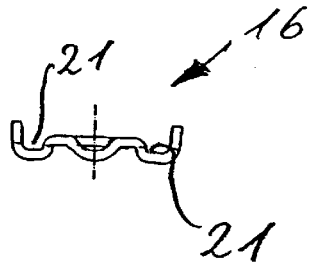
Figure 2:
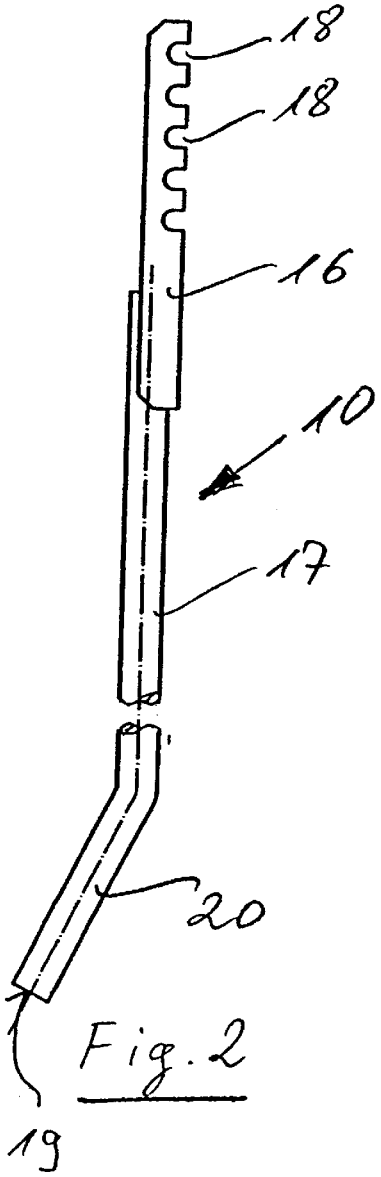
Figure 3:
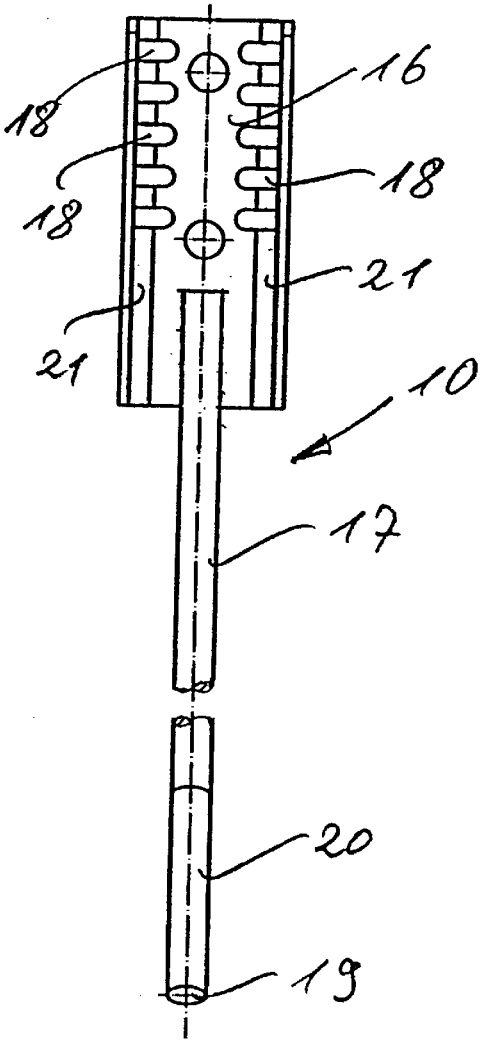

The angle of the foot 2 that pivots at the end of the leg 1 it is articulated to in the specified embodiment is established by a foot-adjustment slide 10, illustrated in detail in FIGS. 2 through 4.

Foot 2, leg 1, and arm 5, are all fabricated of sheet metal and have a U-shaped cross-section, with a web 12 and two flanges 11. The web 12 on arm 5, however, does not extend all the way to the end remote from its free end. At the remote end, each flange 11 is provided with an approximately 180• segment 13 of cogs, rounded in the illustrated embodiment. The web 14 of leg 1 has an outward bulge 15 at this point to create space for segments 13.

Foot-adjustment slide 10 is in two parts, specifically an adaptor 16 and a foot-displacement component 17. The adaptor 16 in the illustrated embodiment is of sheet-metal and has a W-shaped cross section. The cogs in segment 13 engage counterparts in the form of matching cutouts 18 in the adaptor. The foot-displacement component 17 in the illustrated embodiment is a rod with a bent section 20 at its lower end 19. Lower end 19 rests against the web, which constitutes the bottom 3, of foot 2. Lower end 19 will rest against foot 2 at a different point in accordance with the length and angle of bent section 20, adapting the foot's position to the particular characteristics of the vehicle being lifted.

The two-part design of foot-adjustment slide 10 not only saves weight and simplifies manufacture but also allows the jack to be employed with different models of vehicle while retaining many similar parts. Furthermore, various materials can be combined to fabricate adaptor 16 and foot-displacement component 17. Adaptor 16 for instance can be of injection-molded or cast plastic instead of sheet metal.

It can just as well be a metal casting. Another advantage is that the same load-supporting arm 5 with the same cogs and the same adaptor 16 can be combined with legs 1 of different lengths just by combining foot-displacement components 17 of different lengths with the adaptor. Adaptor 16 can be fastened to foot-displacement component 17 by welding, clamping, or calking for example.

The W-shaped cross-section of adaptor 16 is particularly evident in FIG. 4, which depicts it with two longitudinal grooves 21. The advantage of this structure is that the cogged segments 13 of load-supporting arm 5 are laterally secured by the sides of the grooves, preventing the segments from tilting out of position.

LIST OF PARTS

1. leg
2. foot
3. bottom of foot
4. ground

5. arm

6. free end of load-supporting arm

7. threaded shaft

8. upper end of foot

9. crank

10. foot-adjustment slide

11. flange

12. web of load-supporting arm

13. cogged segment

14. web of leg

15. bulge

16. adaptor

17. foot-displacement component

18. cutouts

19. lower end of foot-displacement component

20. bent section of foot-displacement component

21. longitudinal groove

What is claimed is:

1. An automotive jack with a vertical main structure resting on the ground and comprising a leg, a foot, and a load-supporting arm swingable around a fixed horizontal axis on said leg, arm being raisable away from and lowerable toward the ground by a threaded shaft; said arm having a free end with a vehicle-engaging component; a cogged segment at an end of said arm adjacent to the foot, said cogged segment engaging matching cutouts in a foot-adjustment slide on said leg and displacing said slide parallel to the length of said leg, said slide comprising at least two parts; an adaptor holding said counterparts and a foot-displacement component fastened to said adaptor, said slide being adaptable to legs of different lengths.

2. The jack as defined in claim 1, wherein said foot-displacement component comprises a rod and travels back and forth along a foot end of said leg.

3. The jack as defined in claim 1, wherein said adaptor is fastened to said foot-displacement component by welding.

4. The jack as defined in claim 1, wherein said leg has a U-shaped cross-section with a web and said adaptor is sheet-metal and rests with at least one surface against said web.

5. The jack as defined in claim 1, wherein said load-supporting arm has a U-shaped cross-section with flanges and cogs at the same end of each said flanges.

6. The jack as defined in claim 5, wherein said adaptor has a W-shaped cross-section with two longitudinal grooves, said cogs of said load-supporting arm being laterally secured by sides of said grooves.

7. The jack as defined in claim 1, wherein said counterparts are cutouts in said adaptor.

8. The jack as defined in claim 1, said adaptor is cast of metal.

9. The jack as defined in claim 1, wherein said vehicle-engaging component is a fixed component.

10. The jack as defined in claim 1, wherein said vehicle-engaging component is a pivoting component.

11. The jack as defined in claim 1, wherein said adaptor is fastened to said foot-displacement component by clamping.

12. The jack as defined in claim 1, wherein said adaptor is fastened to said foot-displacement component by fastening means.

13. The jack as defined in claim 1, wherein said adaptor is cast of plastic.

14. The jack as defined in claim 1, wherein said adaptor is cast of metal.

15. The adaptor as defined in claim 1, wherein said adaptor is pressed of plastic.

16. The adaptor as defined in claim 1, wherein said adaptor is cast of metal.

17. The jack as defined in claim 1, wherein said two parts of said slide are of different materials.

* * * * *